US010560790B2

(12) United States Patent
Jones

(10) Patent No.: US 10,560,790 B2
(45) Date of Patent: Feb. 11, 2020

(54) METHOD AND A HEARING DEVICE FOR IMPROVED SEPARABILITY OF TARGET SOUNDS

(71) Applicant: Oticon A/S, Smørum (DK)

(72) Inventor: Gary Jones, Smørum (DK)

(73) Assignee: OTICON A/S, Smørum (DK)

( * ) Notice: Subject to any disclaimer, the term of this patent is extended or adjusted under 35 U.S.C. 154(b) by 200 days.

(21) Appl. No.: 15/634,465

(22) Filed: Jun. 27, 2017

(65) Prior Publication Data

US 2017/0374478 A1 Dec. 28, 2017

(30) Foreign Application Priority Data

Jun. 27, 2016 (EP) ..... 16176513

(51) Int. Cl.
*H04R 25/00* (2006.01)

(52) U.S. Cl.
CPC ..... *H04R 25/505* (2013.01); *H04R 25/554* (2013.01); *H04R 2225/41* (2013.01); *H04R 2225/43* (2013.01); *H04R 2430/03* (2013.01)

(58) Field of Classification Search
CPC ..... H04R 25/505; H04R 2225/43; H04R 2430/03; H04B 1/665; G10L 21/0364; G10L 15/02; G10L 25/18
USPC ..... 381/321
See application file for complete search history.

(56) References Cited

U.S. PATENT DOCUMENTS

| | | | | |
|---|---|---|---|---|
| 4,630,305 | A | 12/1986 | Borth et al. | |
| 6,732,073 | B1 | 5/2004 | Kluender et al. | |
| 8,023,673 | B2 | 9/2011 | Vandali et al. | |
| 9,877,118 | B2 * | 1/2018 | Kornagel | H04R 25/505 |
| 2009/0304203 | A1 * | 12/2009 | Haykin | G10L 21/02 381/94.1 |
| 2016/0316303 | A1 * | 10/2016 | Kornagel | H04R 25/505 |

OTHER PUBLICATIONS

Hall et al., "Detection in noise by spectro-temporal pattern analysis," The Journal of the Acoustical Society of America, vol. 76, No. 1, Jul. 1984, pp. 50-56.

(Continued)

*Primary Examiner* — Phylesha Dabney
(74) *Attorney, Agent, or Firm* — Birch, Stewart, Kolasch & Birch, LLP

(57) ABSTRACT

A hearing device, a hearing system and a method for improving a hearing impaired person's ability to perceptually separate a target sound from competing sounds, the target sound and the competing sounds forming a composite sound signal having a given frequency range, where the method comprises the steps of: (i) subdividing the frequency range of the composite sound signal into a plurality of frequency sub-bands; (ii) grouping frequency sub-bands based on comparable characteristics of the plurality of frequency sub-bands; (iii) for each of the groups calculating a group envelope; and (iv) multiplying the signal in the frequency sub-bands of each individual group by a function or functions that enhance(s) peaks of the group envelope and/or attenuates energy in troughs in the group envelope. The comparable characteristics may be the correlation between the envelope of each of the bands in the specific group of frequency sub-bands and the corresponding group envelope.

23 Claims, 7 Drawing Sheets

(56) References Cited

OTHER PUBLICATIONS

Nelken et al., "Responses of auditory-cortex neurons to structural features of natural sounds," Nature, vol. 397, Jan. 14, 1999, pp. 154-157.
Bom Jun Kwon, "Comodulation masking release in consonant recognition", The Journal of the Acoustical Society of America, vol. 112, Aug. 2002, pp. 634-641.
Stephan M. A. Ernst et al., "Suppression and comodulation masking release in normal-hearing and hearing-impaired listeners", The Journal of the Acoustical Society of America, vol. 128, Jul. 2010, pp. 300-309.

* cited by examiner

METHOD AND A HEARING DEVICE FOR IMPROVED SEPARABILITY OF TARGET SOUNDS

SUMMARY

The present disclosure generally relates to methods for improving a hearing impaired user's ability to perceptually separate a target sound from competing sounds, where the target sound and the competing sounds are superimposed in a composite input signal. More specifically, the disclosure relates to the application of comodulation between frequency sub-bands for improving the separation effect.

People whose hearing is completely unimpaired can break a complex mixture of signals into multiple individual signals such that they can then attend to the signal or signals of their choosing. Those with hearing loss, on the other hand, typically have great difficulty understanding speech in the presence of other, competing sounds. Existing hearing aid technology does not offer sufficient support to meet their needs in complex listening environments. This is due to the amplification via a prior art hearing aid being only able to restore the audibility and loudness of sounds. Use of a prior art hearing aid does not restore the ability to "unmix" a complex mixture of sounds.

Consequently, there is a need to provide a hearing instrument, such as a hearing aid, that not only restores the audibility and loudness of sounds provided to a hearing aid user through the hearing instrument, but that also improves the hearing impaired user's ability to perceptually separate a target sound (for instance speech) from competing sounds (such as multiple speakers or other noises in the surroundings).

A purpose of the present disclosure is to enhance comodulation cues.

A Hearing Device:

In a broad aspect, a hearing device, e.g. a hearing aid, configured to operate at least partially in the time-frequency domain (on a frequency sub-band level), and configured to improve perception of a target (speech) signal received by the hearing device as a composite signal comprising said target signal and competing sound components ('noise' or 'masker sound') is provided by the present disclosure. The hearing device comprises a perception enhancement unit based on comodulation. The perception unit is configured to monitor modulation (e.g. amplitude modulation) of competing sound components in at least some (selected) frequency sub-bands. Instead of attempting to improve a (target) signal to noise ratio of said frequency sub-bands, the perception unit is configured in a way that may actually decrease the signal to noise ratio in (at least some of) the frequency sub-bands by applying comodulation reflecting said modulation of the competing sound components to at least some of the frequency sub-bands.

In an aspect of the present application, a hearing device for improving a hearing impaired user's ability to perceptually separate a target sound from competing sounds, the target sound and the competing sounds forming a composite sound signal having a given frequency range is provided. The hearing device further comprises,

- an input unit for providing a time-domain electric input signal y(n) as digital samples representing said composite sound signal in a frequency range of operation forming part of said given frequency range, n being a time-sample index,
- an analysis filter bank subdividing said frequency range of operation, or a part thereof, of said composite sound signal into a plurality of frequency sub-bands and providing corresponding frequency sub-band signals;
- a signal processing unit connected to said analysis filter bank and comprising
  - a band grouping unit for arranging frequency sub-bands in sub-band-groups based on comparable characteristics among the plurality of frequency sub-band signals;
  - an envelope extraction unit for calculating a group envelope for each of said sub-band groups, said group envelope comprising peaks and troughs;
  - an enhancement unit for providing an enhancement function for each sub-band group configured to enhances said peaks in the group envelope and/or attenuate said troughs in the group envelope; and
  - a combination unit for multiplying a signal in the frequency sub-bands of each individual sub-band-group by a respective enhancement function for the sub-band group in question, or a scaled version thereof, to provide enhanced frequency sub-band signals.

Thereby an improved hearing device may be provided.

In the present disclosure the terms 'band' and 'frequency sub-band' are used interchangeably without any intended difference in meaning to indicate a sub-range of a frequency range of operation of the method or device in question. Likewise, the terms 'group' (when used in relation to a group of bands or frequency sub-bands) and 'sub-band group' are intended to have the same meaning.

In an embodiment, the combination unit is configured to multiply a majority of or all frequency sub-band signals of a given sub-band group with the enhancement function corresponding to that group. In an embodiment, the combination unit is configured to multiply a majority of or all frequency sub-band signals of a given sub-band group with a (possibly individually) scaled version of the enhancement function corresponding to that group.

In an embodiment, the signal processing unit comprises a further processing unit for applying a frequency and/or level dependent gain or attenuation and/or other signal processing algorithms to said frequency sub-band signals or to said enhanced frequency sub-band signals to provide processed frequency sub-band signals.

In an embodiment, the hearing device comprises a synthesis filter bank for converting said processed frequency sub-band signals to a time-domain electric output signal.

In an embodiment, the hearing device comprises an output unit for converting the time-domain electric output signal to stimuli perceivable by the user as sound. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises a hearing aid, a headset, an earphone, an ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. In an embodiment, the hearing device comprises a directional microphone system adapted to spatially filter sounds from the environment, and thereby e.g. enhance a target acoustic source relative to other acoustic sources in the local environment of the user wearing the hearing device. In an embodiment, the directional system is adapted to detect (such as adaptively detect) from which direction a particular part of the microphone signal originates (e.g. a target signal, and/or one or more noise sound sources).

In an embodiment, the hearing device comprises an antenna and transceiver circuitry for wirelessly receiving a direct electric input signal from (e.g. establishing a communication link to) another device, e.g. a communication device or another hearing device. In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 48 bits, e.g. 24 bits. A digital sample x has a length in time of 1/f e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit, comprise(s) a TF-conversion unit (e.g. an analysis filter bank) for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{min}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency sub-bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the predefined criterion comprises whether the current level of a signal of the forward path is within one or more ranges of level-values.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising, human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing device.

In an embodiment, the hearing device comprises an acoustic (and/or mechanical) feedback suppression system. In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method for improving a hearing impaired person's ability to perceptually separate a target sound from competing sounds, the target sound and the competing sounds forming a composite sound signal having a given frequency range is furthermore provided by the present application. The method comprises providing a time-domain electric input signal y(n) as digital samples representing said composite sound signal in a frequency range of operation forming part of said given frequency range, n being a time-sample index, subdividing said frequency range of operation, or a part thereof, of said composite sound signal into a plurality of frequency sub-band;

arranging frequency sub-bands in sub-band-groups based on comparable characteristics among the plurality of frequency sub-bands;

calculating a group envelope for each of said sub-band groups, said group envelope comprising peaks and troughs; and multiplying a signal in the frequency sub-bands of each individual sub-band-group by a function that enhances said peaks of the group envelope and/or attenuates said troughs in the group envelope, thereby providing an enhancement envelope for each of said sub-band-groups.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The function that 'enhances said peaks of the group envelope and/or attenuates said troughs in the group envelope' is also termed the enhancement function. In an embodiment, the method comprises multiplying all frequency sub-band signals of a given sub-band group with the (enhancement) function corresponding to that group. In an embodiment, the combination unit is configured to multiply all frequency sub-band signals of a given sub-band group with a (possibly individually) scaled version of the enhancement function corresponding to that group.

The group envelope may e.g. be determined by one of the following methods (alone or in combination):

a. Half-wave rectification followed by low-pass filtering.

b. One band at a time and then an un-weighted or weighted average of the envelopes.

c. Filter bank, pass through bands that are in the group and zero out bands that are not in the group, then extract the envelope of the resulting time waveform->this is the group envelope.

d. Filter bank, multiply the bands that are in the group by weighting coefficients and zero out bands that are not in the group, then extract the envelope of the resulting time waveform->this is the group envelope.

e. Hilbert envelope.

In an embodiment, the comparable characteristics comprises the correlations among the signal envelopes in said multiple frequency sub-bands.

In an embodiment, the method comprises:

for each of said frequency sub-bands calculate the envelope of the band;

for each of the sub-band-groups calculate the correlation between the envelope of each of the frequency sub-bands in the specific sub-band-group and the corresponding group envelope;

for each of the sub-band groups calculate the enhancement envelope for each frequency sub-band in the sub-band-group in question;

for each frequency sub-band multiply the signal in the band with the enhancement envelope of the band.

In an embodiment, the method comprises:

calculate the correlation between the envelopes of each of said frequency sub-bands, thereby providing a correlation matrix C;

based on said correlation matrix C group the frequency sub-bands into said sub-band-groups;

calculate a group envelope for each of the sub-band-groups;

In an embodiment, the arrangement of frequency sub-bands in sub-band-groups ('grouping') comprises the following steps:

defining a threshold for correlation C_thr;

selecting the row of the correlation matrix C that has the highest sum of supra-threshold values;

designating the frequency sub-bands for which correlations in the selected row are greater than C_thr as the members of a first sub-band-group;

In an embodiment, the grouping further comprises setting the elements in the rows and columns of the correlation matrix C corresponding to the frequency sub-bands of said first sub-band-group equal to zero, thereby providing a modified correlation matrix $C_M$;

selecting the row of the modified correlation matrix $C_M$ that has the highest sum of suprathreshold correlations;

designating the frequency sub-bands for which correlations in the selected row are greater than C_thr as members of a second sub-band-group.

In an embodiment, the enhancement of peaks of the group envelope and attenuation of troughs in the group envelope comprises the following steps:

defining a modulation enhancement m_enh;

for the defined modulation enhancement (m_enh) keeping a running tally of the group envelope's mean value, modulation depth m_group and the current amplitude offset at time n relative to said mean value, where the modulation depth is given by m_group;

for each frequency sub-band in each respective sub-band-group:

multiplying the signal in a current time window by $(1+p(n)*c(n)*m_enh)$, where $0 \leq p(n) \leq 1$, and where p(n) is a function of the band envelope's correlation with the group envelope.

In an embodiment, the modulation enhancement m_enh is divided in two enhancement parts, one that controls the extent of peak enhancement and one that controls the extent of deepening of troughs.

In an embodiment, the comparable characteristics are fundamental frequencies $F_{0k}$ in the amplitude variation of each separate frequency sub-band, where k is a frequency sub-band index.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing Device Comprising a Data Processing System:

In an aspect, a hearing device, e.g. a hearing aid, for improving a hearing impaired user's ability to perceptually separate a target sound from competing sounds, where the hearing device comprises a data processing system as described above, in the 'detailed description of embodiments' and in the claims is furthermore provided by the present application.

Thereby a stream segregation cue enhanced output signal for presentation to a user of the hearing device is provided.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other. In an embodiment, the hearing system is configured to run an APP allowing to control functionality of the hearing system via the auxiliary device.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the auxiliary device is or comprises a smartphone. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system. In an embodiment, the hearing system comprises two hearing devices adapted to implement or form part of a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system. In an embodiment, the APP is configured to control functionality of the hearing system.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids, headsets, ear phones, active ear protection systems, handsfree telephone systems, mobile telephones, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Figure 1B:
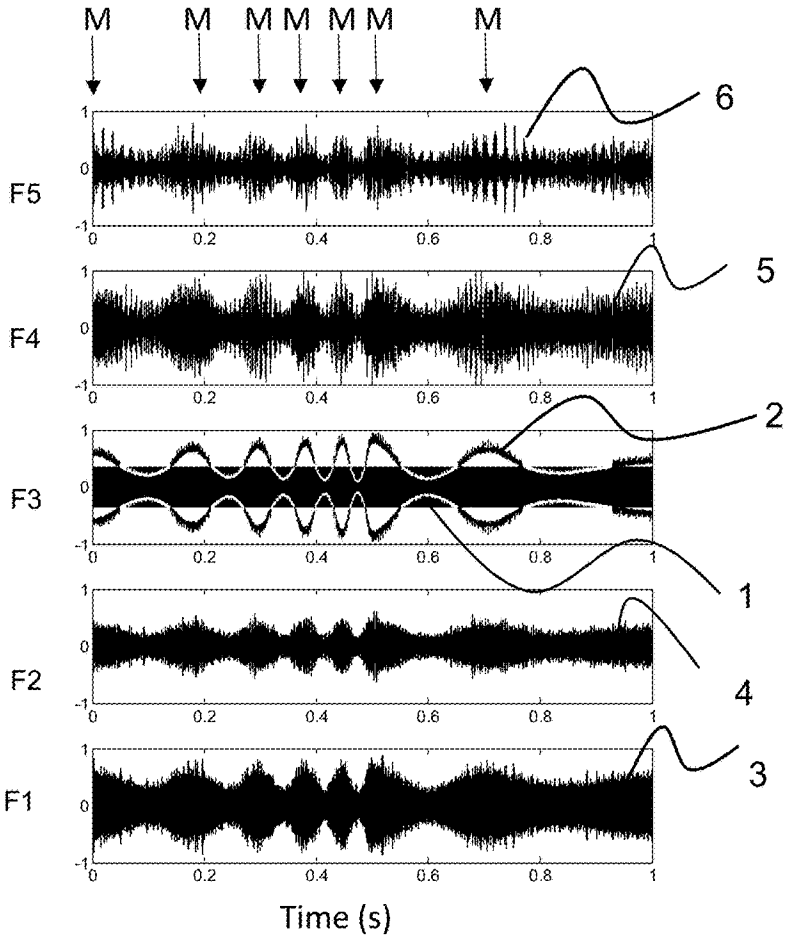
FIGS. 1A and 1B show the basic principle that having comodulation of a masker signal over a plurality of frequency sub-bands improves auditory perception of a target signal present together with the masking signal.
Figure 1A:
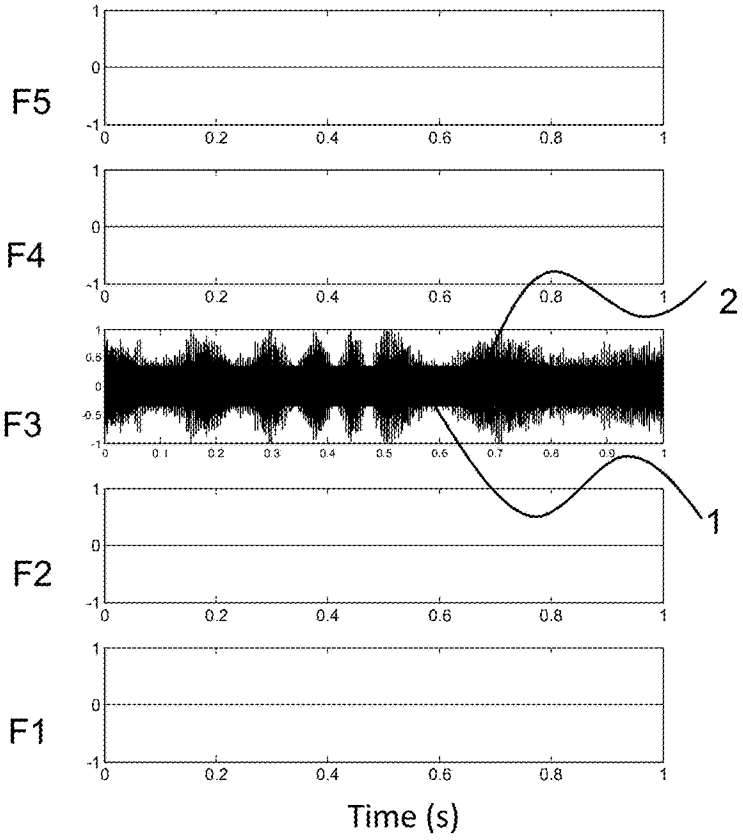

FIGS. 1A and 1B shows the basic principle that having comodulation of a masker signal over a plurality of frequency sub-bands improves auditory perception of a target signal present together with the masking signal. A number (here 5) of frequency sub-band signals (F1, F2, F3, F4, F5) are shown with (normalized) relative amplitudes between −1 and 1 for a time segment of 1 s (cf. horizontal axis Time (s)').

One of the key cues for improving a hearing impaired user's ability to perceptually separate a target sound from competing sounds is comodulation, where "comodulation" refers to amplitude modulations that are shared across multiple frequency sub-bands (cf. e.g. [Hall et al., 1984] or [Nelken et al., 1999]). FIGS. 1A and 1B represent a schematic illustration of comodulation and its perceptual consequence: The target sound and masker sound seem more perceptually separable when multiple comodulated masker bands are present.

In the constructed example shown in FIGS. 1A and 1B, schematic amplitude-time plots of a relatively constant-envelope target signal (reference number 1) mixed with 'noise' (i.e. non-target) signal(s) having a time-varying envelope (reference number 2) are shown. The target sound (1) in the middle frequency sub-band (F3) is masked by a competing sound (2) in the middle frequency sub-band (F3), and it is difficult to detect the target (FIG. 1A). The principle that is illustrated by the figure is that the presence of multiple (comodulated) 'masker bands' (FIG. 1B) seems to make it easier to perceptually separate out target (1) and masker (2) from one another (indicated by a clearer appearance of the constant envelope target signal (1) in frequency sub-band F3 of FIG. 1B). There is extensive evidence for this beginning with [Hall et al., 1984] and from numerous subsequent studies that found improved detection thresholds when comodulated flanking bands were added to a masker.

The plot shown in FIG. 1A illustrates the role of comodulation in enhancing the perceptual separability of a target (1) from a masker (2). In FIG. 1A, the target (1) and a masker (2) are only present in the third frequency sub-band F3 and the other bands F1, F2, F4 and F5 of FIG. 1A are silent, i.e. they contain neither a target sound nor masking sounds. In FIG. 1B, the third frequency sub-band F3 still contains both the target (1) and the masker (2), but the other frequency sub-bands F1, F2, F4 and F5 contain masking sound frequency components. Specifically, in FIG. 1B, masker energy is present in all frequency sub-bands F1 through F5 and the masker is comodulated across these bands as indicated by the arrows denoted M in the top part of FIG. 1B. The perceptual consequence of having several comodulated masker bands is that it provides a cue that helps the listener perceptually segregate the masker from the target. Although the target (1) is the same in FIGS. 1A and 1B, listeners can more easily detect the target (1) in the example shown in FIG. 1B.

It should be noted that the presence of the masker in the frequency sub-bands F1, F2, F4 and F5 makes the signal-to-noise ratio, where here we mean the sum of the energy in all of these frequency sub-bands, substantially worse than if the complete signal were present only in F3, as in FIG. 1A. Nevertheless, target detection (perception) gets better in the situation shown in FIG. 1B, as a result of comodulation of the masker between the frequency sub-bands. The principles that allow improved detection of the narrowband target in the simple example illustrated in FIGS. 1A and 1B are also believed to be important for segregating multiple broadband targets from each other.

The example shown in FIGS. 1A and 1B illustrates an essential feature that distinguishes the solution provided by the present disclosure from prior art noise reduction systems. Namely, prior art noise reduction systems treat masker energy as inherently detrimental to perception of the target, and they aim to reduce it. Contrary to this prior art approach, the solution according to the present disclosure comprises enhancing comodulation cues with the aim to (at least partially) restore the very important segregation ability of normal hearing in the hearing impaired, and that widely-held belief partly motivates the current patent application.

As it appears from FIGS. 1A and 1B, the input signal is generally a composite signal comprising both a target signal (such as a speech signal) and a competing signal (such as background noise and/or one or more competing voice signals). According to the present disclosure, a signal stream segregation is performed on this composite input signal in a process that may comprise:

i. Subdividing the composite input signal in a plurality of frequency sub-bands (Band 1, Band 2, . . . Band N, cf. e.g. FIG. 2A);

ii. Grouping the frequency sub-bands based on similar characteristics in the respective bands (i.e. characteristics of the individual time variant band signals that are similar for each of the bands, such as the band signal's envelopes or characteristic frequencies, e.g. fundamental frequencies, cf. e.g. FIG. 2A);

iii. For each of the determined groups of frequency sub-bands calculating a group envelope of the signal in the respective band (cf. e.g. FIG. 2B); and iv. multiplying the signal in the bands of each individual group by a function that enhances (amplitude or energy in) peaks of the group envelope and/or attenuates (amplitude or energy in) troughs in the group envelope (cf. e.g. FIG. 2B).

Figure 3:
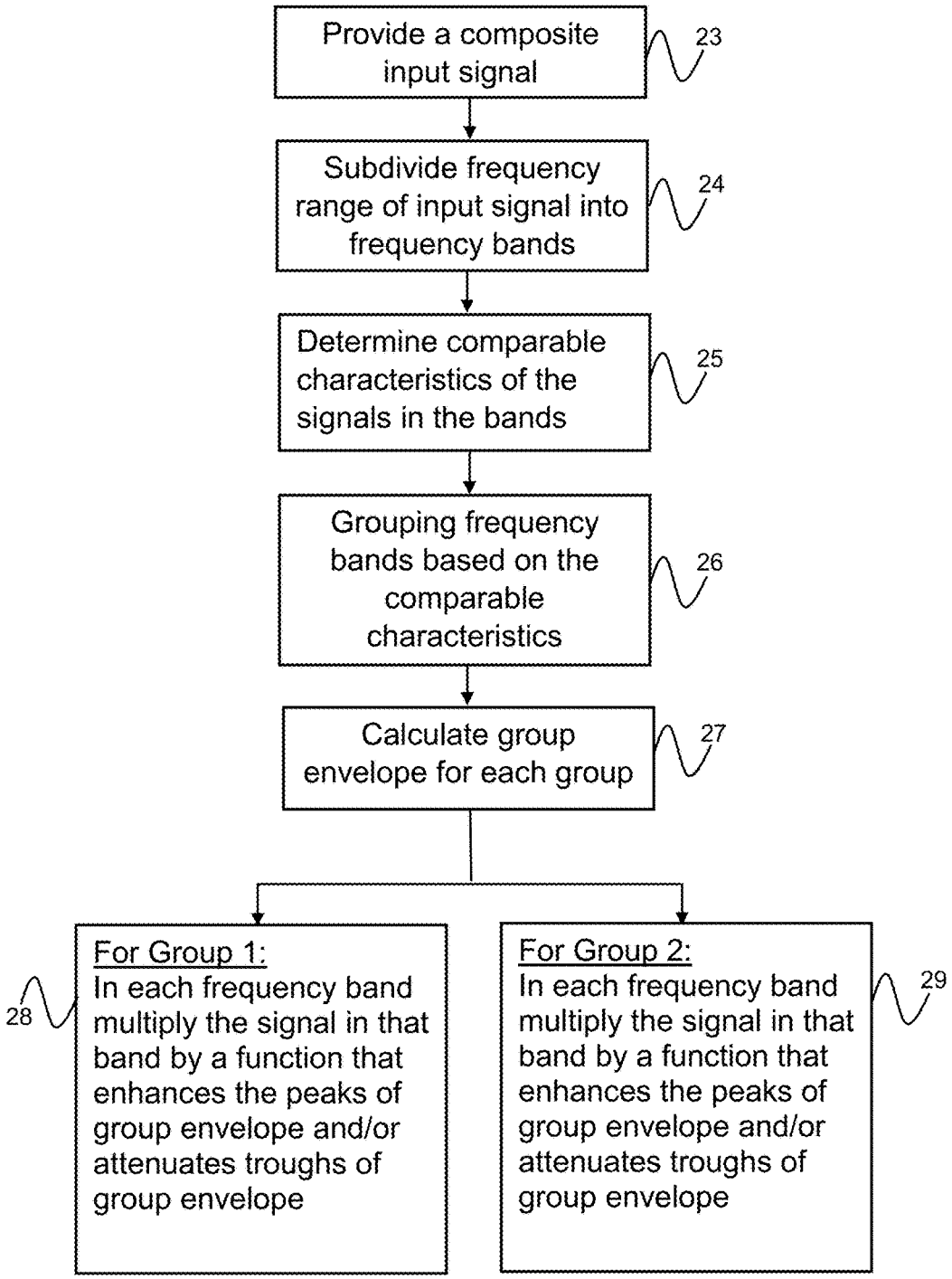
FIG. 3 shows a flow chart of a first embodiment of the method according to the present disclosure.

Thus, according to a first aspect of the present disclosure (of which an embodiment is illustrated in FIG. 3) there is provided a method for improving a hearing impaired person's ability to perceptually separate a target sound from competing sounds, the target sound and the competing sounds forming a composite sound signal having a given frequency range, where the method comprises the following steps:

subdividing the frequency range of said composite sound into a plurality of frequency sub-bands;

grouping frequency sub-bands based on comparable characteristics of the signals of the plurality of frequency sub-bands;

for each of said sub-band groups calculating a group envelope;

multiplying the signal in the bands of each individual sub-band group by a function that enhances peaks of the group envelope and/or attenuates troughs in the group envelope.

In an embodiment, the magnitude of the peak enhancement is greater for some bands within the sub-band group than for other bands within the sub-band group. In an embodiment, the magnitude of the enhancement is dependent on the correlation between the individual band's envelope and the group envelope. In an embodiment of the first aspect, the magnitude of the trough attenuation is greater for some bands within the sub-band group than for other bands within the sub-band group. In an embodiment, the magnitude of the attenuation is dependent on the correlation between the individual band's envelope and the group envelope.

It should be noted that the magnitude of enhancement, or attenuation, can be made dependent on the correlation of each individual band's envelope with its sub-band group's envelope, even if non-correlation-based methods (e.g., fundamental frequency F0) are used to select the sub-band groups.

In an embodiment, the comparable characteristic is the correlations among the signal envelopes in said multiple frequency sub-bands (e.g. in those frequency bands that exhibit correlation with each other in a specific range of a correlation measure (e.g. cross-correlation) are allocated to the same sub-band group).

In an embodiment, the comparable characteristics are fundamental frequencies $F_{0k}$ (and/or harmonics thereof) in the amplitude variation over time of each separate frequency sub-band, where k is a frequency sub-band index.

In an embodiment, the method comprises the steps of:

for each of said frequency sub-bands calculate the envelope of the band;

for each of the sub-band groups calculate the correlation between the envelope of each of the bands in the specific sub-band group and the corresponding group envelope;

for each of the sub-band groups calculate the enhancement envelope for each band in this sub-band group;

for each band multiply the signal in the band with the enhancement envelope of the band.

In an embodiment, the method comprises the steps of:

for each of said frequency sub-bands calculate the envelope of band;

calculate the correlation between the envelopes of each of said frequency sub-bands, thereby providing a correlation matrix C;

based on said correlation matrix C, group the frequency sub-bands into sub-band groups;

calculate a group envelope for each of the sub-band groups;

for each of the sub-band groups calculate the correlation between the envelope of each of the bands in the specific sub-band group and the corresponding group envelope;

for each of the sub-band groups calculate the enhancement envelope for each frequency sub-band in this sub-band group;

for each frequency sub-band multiply the signal in the band with the enhancement envelope of the frequency sub-band.

In an embodiment of the first aspect, the grouping comprises the steps of:

a threshold for correlation C_thr is defined;

the row of the correlation matrix C is selected that has the highest sum of suprathreshold values;

the bands for which correlations in the selected row are greater than C_thr are designated as the members of a first group;

in the rows and columns of the correlation matrix C corresponding to the bands of said first sub-band group, the elements of are set equal to zero, thereby providing a modified correlation matrix $C_M$;

the row of the modified correlation matrix $C_M$ that has the highest sum of suprathreshold correlations is selected;

the bands for which correlations in the selected row are greater than C_thr are designated as members of a second sub-band group.

In an embodiment, where more than 2 groups of bands are identified, a second modified correlation matrix $C_M'$ is preferably formed and a $3^{rd}$ group of bands selected, and so on until either all OFF-diagonal elements of the modified matrix are below C_thr or until some predefined maximum number of groups is reached.

In an embodiment of the first aspect, the accentuation of peaks of the group envelope and attenuation of energy in troughs in the group envelope comprises the following steps:

defining a modulation enhancement m_enh;

for the defined modulation enhancement (m_enh) keeping a running tally of the group envelope's mean value, modulation depth m_group and the current amplitude offset at time n relative to said mean value, where the offset value, c(n), gives the current value of the group envelope relative to its running mean value. The time-varying function c(n) represents the group modulation envelope and is defined such that c(n) is positive when the group envelope is above its running mean and negative when the group envelope is below its running mean.

for each frequency sub-band (index k) in each respective sub-band group (index j):

multiplying the signal in a current time window by (1+p(n)*c(n)*m_enh) (termed the 'enhancement envelope' or the 'enhancement function' $f_e(j,p(k,n))$ in relation to FIG. 6 below), where $0 \leq p(n) \leq 1$, and where p(n) determines how much of m_enh is applied in the band (k) at a given point in time; p(n) can, for example, be set to depend on the band envelope's correlation with the group envelope;

multiplying the signal by (1+p(n)*c(n)*m_enh); thereby increasing the magnitude of the peaks and deepening the troughs of the comodulation among the bands in the group.

In an embodiment the frequency sub-band specific parameter p(n) depends on inputs from detectors or classifiers.

In an embodiment of the first aspect, the modulation enhancement m_enh is divided in two enhancement parts, one that controls the extent of peak enhancement and one that controls the extent of deepening of troughs. This has the advantage that the enhancement of the two parts can be independently controlled. In an embodiment specific limitations may be put on the maximum allowed peak enhancement. In an embodiment specific limitations may be put on the maximum allowed trough attenuation, e.g., to prevent the modulation envelope from crossing zero signal amplitude, yielding a greater than 100 percent modulation (overmodulation).

According to a second aspect of the present disclosure, there is provided a hearing device for improving a hearing impaired user's ability to perceptually separate a target sound from competing sounds, where the hearing device comprises a processor configured for carrying out the method according to the first aspect of the present disclosure, thereby providing a stream segregation cue enhanced output signal for presentation to a user of the hearing device.

In an embodiment of the second aspect, the hearing device is or comprises a hearing aid.

According to a third aspect of the present disclosure, there is provided a data processing system comprising a processor provided with software adapted to perform at least some (such as a majority or all) of the steps of the method according to the first aspect of the disclosure.

According to a fourth aspect of the present disclosure, there is provided software able to perform the method according to the first aspect of the disclosure, which software may be stored on or encoded as one or more instructions or code on a tangible computer-readable medium. The computer readable medium includes computer storage media adapted to store a computer program comprising program codes, which when run on a processing system causes the data processing system to perform at least some (such as a majority or all) of the steps of the method according to the first aspect of the disclosure.

Figure 2A:
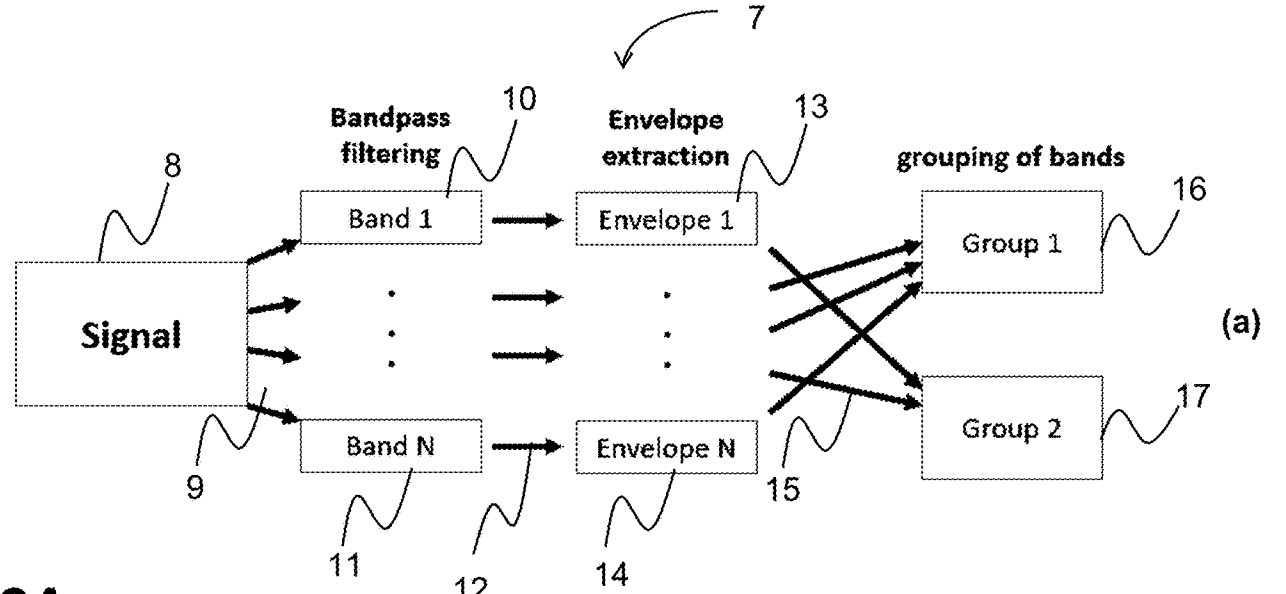
FIG. 2A shows an example embodiment of a first part of a method according to the present disclosure.
Figure 2B:
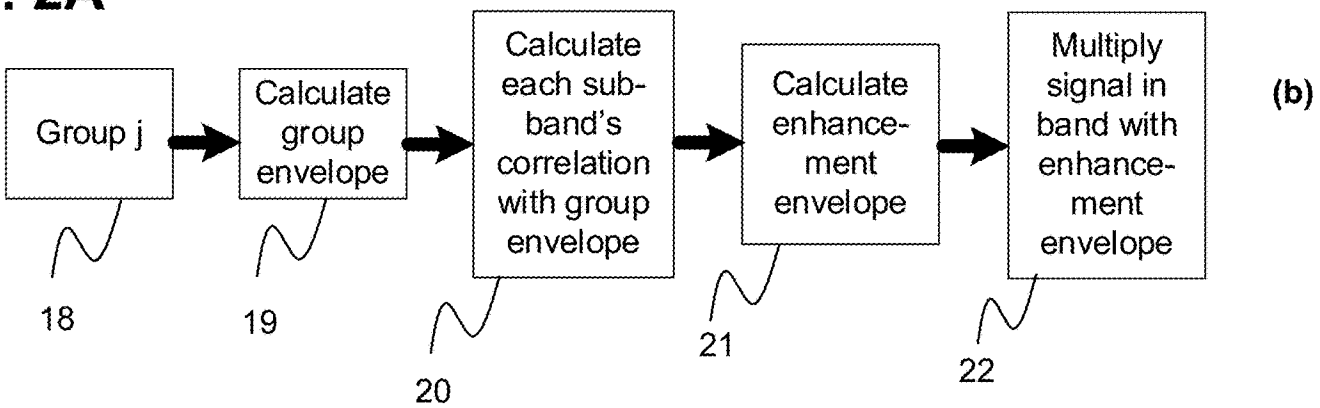
FIG. 2B shows an example embodiment of a second part of a method according to the present disclosure.

FIG. 2A shows an example embodiment of a first part of a method according to the present disclosure, and FIG. 2B shows an example embodiment of a second part of a method according to the present disclosure.

Referring to FIG. 2A, a signal 8 is provided to a filter bank (e.g. a bank of band pass filters 10, 11). In the example shown in FIGS. 1A and 1B, five such band pass filters were used, but it is understood that any suitable number of such filters may be used as deemed necessary. Each respective of the band pass filters 10, 11 provide a band passed (frequency sub-band) output signal 12. The bands may be overlapping or non-overlapping. The frequency sub-bands (1, . . . , N) may together cover a part of or the entire frequency range of operation of a hearing aid, e.g. from 0 Hz (or 20 Hz or more) to 8 kHz (or more, e.g. 10 kHz or more).

Although the example in FIG. 2A assigns the frequency sub-bands into 2 groups of frequency sub-bands, this approach can easily be extended so as to have 3 or more sub-band groups.

The band passed output signal 12 from each respective band pass filter is provided to a corresponding envelope extractor 13, 14 that determines the envelope as a function of time of the (frequency sub-band) output signal provided by the respective band pass filter. Envelope extraction may e.g. be performed by filtering, rectification and filtering, Hilbert transformation, or phase lock loop techniques.

Figure 5A:
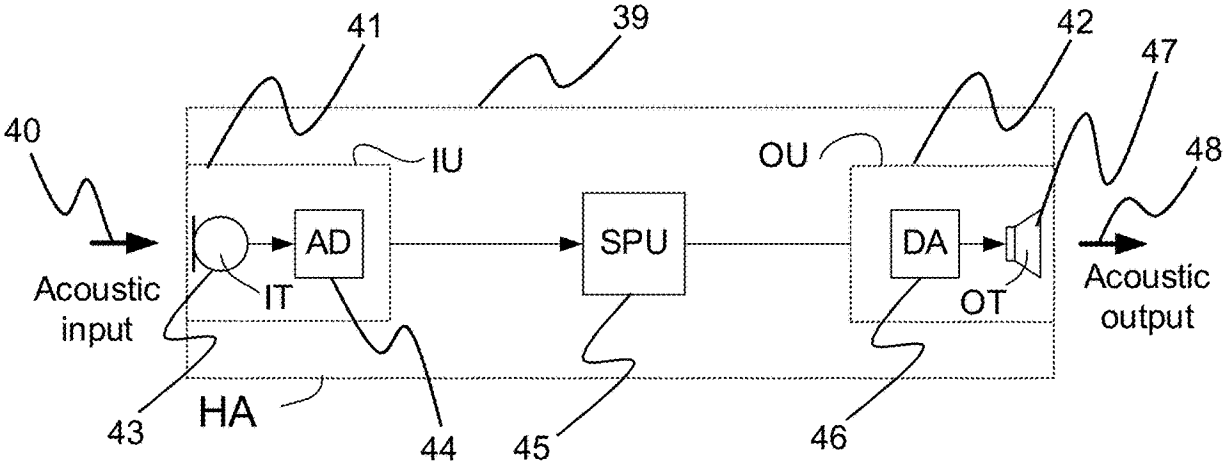
FIG. 5A shows a simplified block diagram of a hearing aid according to a first embodiment of the present disclosure.
Figure 5B:
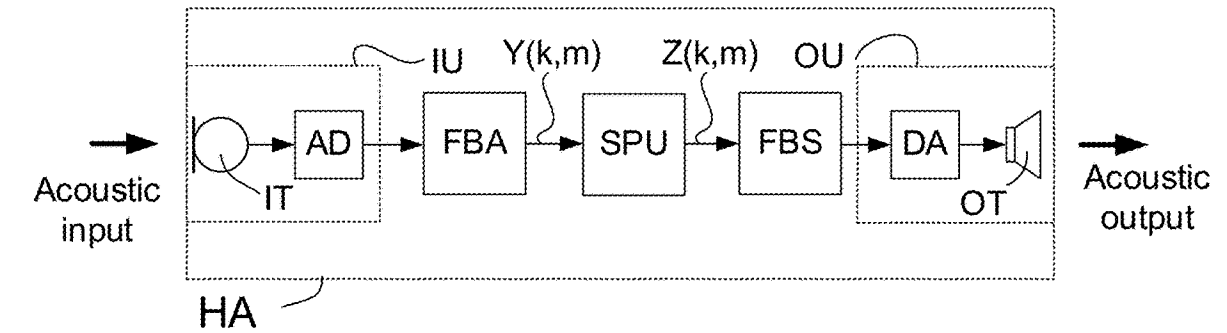
FIG. 5B shows a simplified block diagram of a hearing aid according to a second embodiment of the present disclosure.
Figure 6:
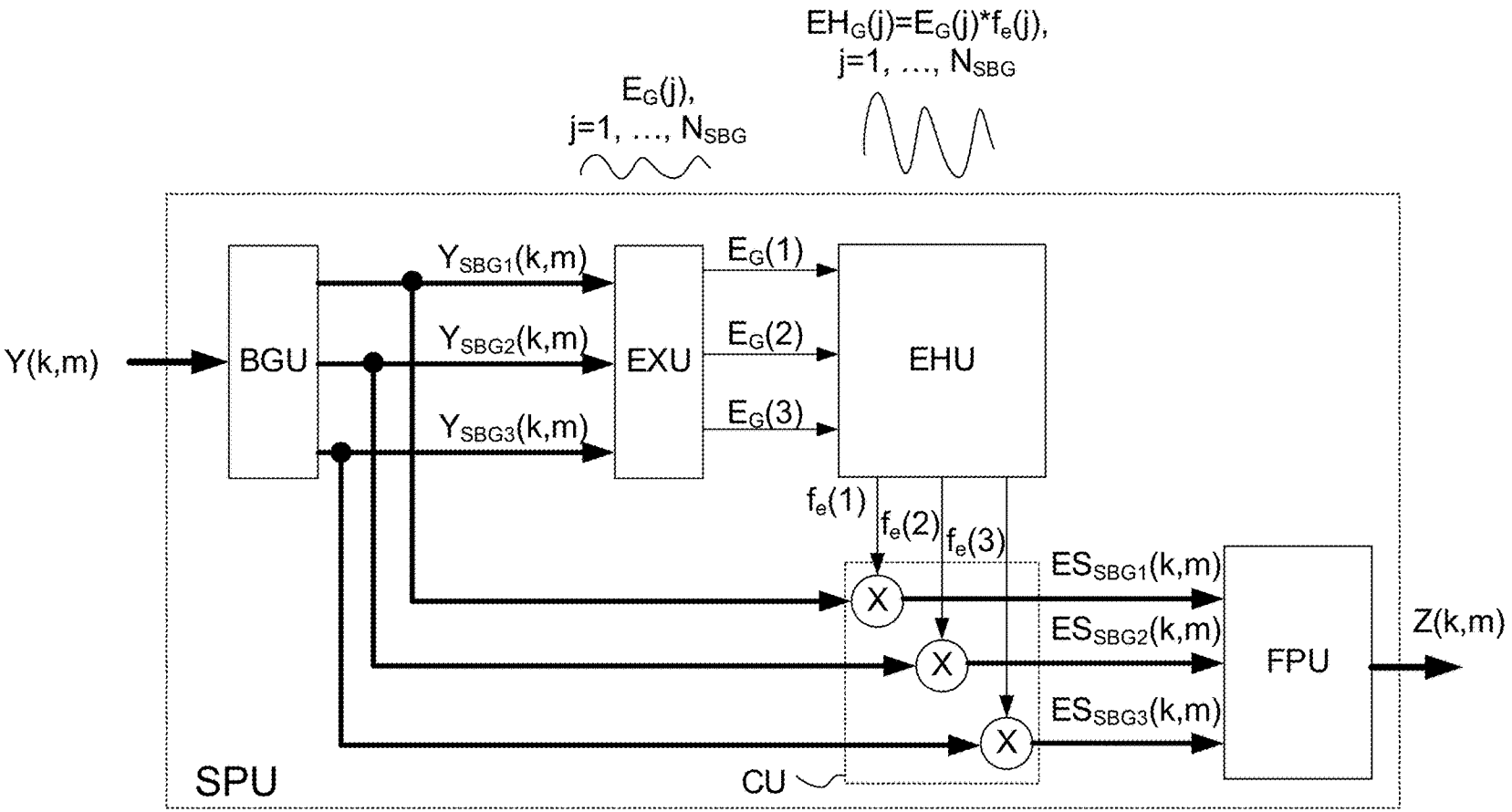
FIG. 6 shows a simplified block diagram of a signal processing unit according to an embodiment of the present disclosure.

Based on the determined signal envelopes of each respective band 1 through N, the correlations among the signal envelopes of the N frequency sub-band signals (cf. Y(k,m) in FIG. 5B, FIG. 6) are calculated, thereby obtaining a correlation matrix C. Based on the content of the correlation matrix C, a grouping of the frequency sub-bands 1 through N may be performed as follows:

Part A: Cross-correlation, thresholding and grouping of bands:

a. A threshold for correlation C_thr is defined;

b. The row of the correlation matrix C is selected that has the highest sum of suprathreshold values;

c. The bands for which correlations in the selected row are greater than C_thr are designated as the members of Group 1;

d. The correlation values of the rows and columns of the correlation matrix C corresponding to Group 1 bands are set equal to zero, thereby providing a modified correlation matrix $C_M$;

e. The row of the modified correlation matrix $C_M$ (modified in the previous step) that has the highest sum of suprathreshold correlations is selected;

f. The bands for which correlations in the selected row are greater than C_thr are designated as the members of Group 2.

The above outlined procedure for obtaining the sub-band groups is illustrated by the further non-limiting example, in which the original correlation matrix is:

| | band 1 | band 2 | band 3 | band 4 | band 5 |
|---|---|---|---|---|---|
| band 1 | 1 | 0.9 | 0.7 | 0.5 | 0.2 |
| band 2 | 0.9 | 1 | 0.5 | 0.5 | 0.3 |
| band 3 | 0.7 | 0.7 | 1 | 0.8 | 0.6 |
| band 4 | 0.5 | 0.5 | 0.8 | 1 | 0.85 |
| band 5 | 0.2 | 0.3 | 0.6 | 0.85 | 1 |

The threshold of correlation C_thr is set to 0.75 in this example (this value may be chosen differently, e.g. to be larger than 0.75 or smaller than 0.75, depending on the particular situation (acoustic environment, configuration of frequency sub-bands, hearing impairment of the user, etc.)). The elements of the original matrix having suprathreshold values are highlighted above.

The row of the correlation matrix C that has the highest sum of suprathreshold values is row 4 (band 4).

The bands of row 4 that have a correlation value greater than C_thr are chosen as Group 1. Thus Group 1 consists of band 3, band 4 and band 5.

The matrix elements corresponding to Group 1 are set equal to zero, thereby yielding the modified matrix:

| | band 1 | band 2 | band 3 | band 4 | band 5 |
|---|---|---|---|---|---|
| band 1 | 1 | 0.9 | 0 | 0 | 0 |
| band 2 | 0.9 | 1 | 0 | 0 | 0 |
| band 3 | 0 | 0 | 0 | 0 | 0 |
| band 4 | 0 | 0 | 0 | 0 | 0 |
| band 5 | 0 | 0 | 0 | 0 | 0 |

The row of the modified matrix above that has the highest sum of supra-threshold correlations is selected. In this example both row 1 and row 2 have the sum 1.9 and the corresponding bands 1 and 2 are selected for Group 2.

According to the disclosure, the grouping of frequency sub-bands could alternatively be based on other methods than the correlation method described above.

In an embodiment of the disclosure, the grouping of frequency sub-bands is based on identification of fundamental frequencies $F_{0k}$ of each separate frequency sub-band k and subsequently grouping bands, which have fundamental frequencies $F_{0k}$ within a predefined range. Subsequent to this grouping of frequency sub-bands, the method continue as described below under Part B (cf. also FIG. 2B).

After the grouping has been performed, each or the determined sub-band groups are subjected to the steps indicated in FIG. 2B.

In step 19 the group envelope is calculated for sub-band group j (j=1 or 2 in the example shown in FIG. 2A). The group envelope can be calculated using a number of different approaches, such as averaging, e.g. frequency weighted averaging, where, for example, bands are weighted by their importance for speech comprehension. Another approach would be summing and subsequent extraction of the envelope of the resulting signal. Other weighting schemes may be used according to the application in question, e.g. depending on the expected input signal, e.g. characteristics of the input signal.

In step 20 the correlation between the envelope of each individual band belonging to Group j and the calculated group envelope is calculated.

In step 21 the enhancement envelope is calculated based on the correlations determined in step 20.

In step 22 the signal in each of the frequency sub-bands belonging to the specific sub-band group is multiplied by the enhancement envelope determined in step 21, thereby providing the desired segregation cue enhanced signal.

Calculation of the enhancement envelope comprises according to an embodiment of the disclosure the following steps:

Part B: Calculation of enhancement envelope:

a. Defining a modulation enhancement (m_enh) for a given sub-band group;

b. For said defined modulation enhancement (m_enh):

c. Keep a running tally comprising the group envelope's:

i. Mean;

ii. Modulation depth (m_group); and iii. Current amplitude offset at time n relative to the mean, expressed as c(n), as described elsewhere in this application.

d. For each frequency sub-band in the sub-band group:

i. Determine the band envelope of the frequency sub-band;

ii. Multiply the frequency sub-band signal in the current time window by (1+p(n)*c(n)*m_enh), where p(n) is between 0 and 1 and can depend on factors that include but are not limited to the band envelope's correlation with the group envelope, inputs from detectors, inputs from classifiers, etc.

Because c(n) under Item c(iii) above reflects the modulation of the group envelope, multiplying the signal by (1+p(n)*c(n)*m_enh) increases the peaks and deepens the troughs of the comodulation among the bands in the sub-band group.

According to an embodiment, the modulation enhancement m_enh is subdivided into two parts, one that controls the extent of peak enhancement and one that controls the extent of deepening of troughs.

Referring to FIG. 3 there is shown a flow chart illustrating basic steps of an embodiment of the method according to the present disclosure.

In step 23 there is provided an input signal, for instance a (processed, time variant) output signal from a microphone in a hearing aid (e.g. comprising a target signal x mixed with noise components v). In step 24 the total frequency range (or optionally a portion hereof) of the input signal is subdivided into a number of frequency sub-bands. In FIG. 1, five such bands were shown, but another number of frequency sub-bands (adjacent or separate) could also be used. In step 25 a comparable characteristic of the signals in the frequency sub-bands is determined. Examples of comparable characteristics would e.g. be the signal envelopes of each of the frequency sub-bands (k), or fundamental frequencies $F_{0k}$ in the amplitude variation over time of each separate frequency sub-band.

In step 26 the frequency sub-bands are grouped based on the comparable characteristics determined in step 25. In the example embodiments described, the frequency sub-bands are grouped in two sub-band groups: Group 1 and Group 2, but it is understood that other numbers of groups could also be used.

In step 27, a group envelope is calculated as described above for each of the determined sub-band groups (j=1, 2).

In steps 28 and 29, respectively, the signal in each of the frequency sub-bands is multiplied by a (enhancement) function that enhances the peaks of the group envelope for the particular sub-band group and that attenuates the troughs of the group envelope for the particular sub-band group (for Group 1 and Group 2, respectively).

Figure 4:
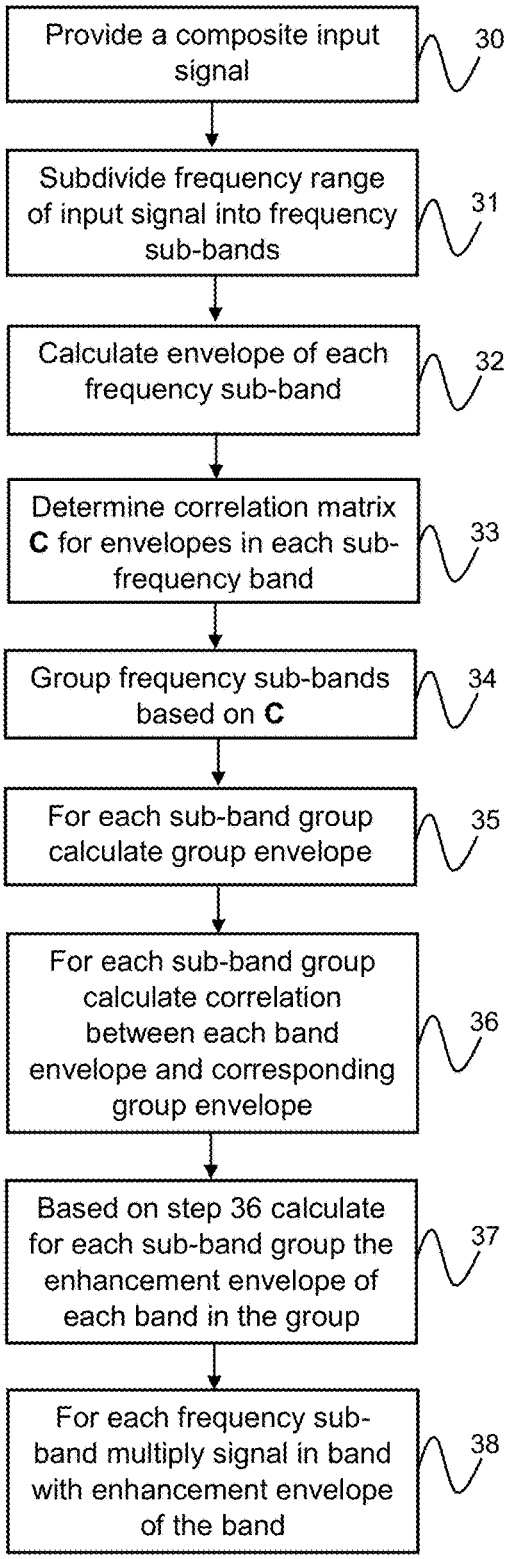
FIG. 4 shows a flow chart illustrating a second embodiment of the method according to the present disclosure.

FIG. 4 shows a flow chart illustrating a second embodiment of the method according to the present disclosure.

In step 30, there is provided an input signal, for instance a (processed) output signal from a microphone in a hearing, aid. In step 31, the total frequency range (or optionally a portion hereof) of the input signal is subdivided into a number of frequency sub-bands, and in step 32, the envelope of the signal in each of the frequency sub-bands are calculated.

In step 33, the correlation between the envelopes of each of the frequency sub-band signals are calculated, thereby providing a correlation matrix C (e.g. as shown in the numerical examples given above).

In step 34, grouping of the frequency sub-bands is performed based on the correlation matrix C, as e.g. described in detail above.

In step 35, a group envelope is determined for each of the sub-band groups found in step 34.

In step 36, the correlation between each band envelope and the corresponding group envelope is determined for each of the sub-band groups.

In step 37, an enhancement envelope is calculated for each frequency sub-band in each sub-band group based on the correlations found in step 36.

In step 38, the signal in each separate frequency sub-band is multiplied with the enhancement envelope of the band determined in step 37.

FIG. 5 shows a simplified block diagram of a hearing aid according to a first embodiment of the present disclosure, and FIG. 5B shows a simplified block diagram of a hearing aid according to a second embodiment of the present disclosure.

Referring to FIG. 5A there is shown a schematic block diagram of a hearing aid (HA) 39 configured to carry out the method according to the present disclosure. The hearing aid 39 comprises an input unit (IU) 41 provided with an input transducer (IT) 43, e.g. a microphone, for converting an acoustic signal (Acoustic input) 40 to an electric signal, which electric signal is provided to an A/D converter (AD) 44. The digital signal from the A/D converter is provided to a signal processing unit (SPU) 45 that comprises software code for executing the various steps of the method according to the present disclosure. The processed output digital signal is provided to a D/A converter (DA) 46 in an output unit (OU) 42, and the analogue signal from D/A converter 46 drives an output transducer (OT) 47, e.g. a loudspeaker (receiver), that converts the electrical output signal to an acoustic output signal (Acoustic output) 48. In embodiments, the output unit may (additionally or alternatively) comprise a vibrator for a bone-conduction type hearing aid or a multi-electrode array of a cochlear implant type hearing aid. The output of the signal processing unit 45 could be the stream segregation cue enhanced signal provided by the method according to the present disclosure or a processed version hereof (cf. e.g. FIG. 6). Further, the signal processing unit 45 may include an analysis filter bank (FBA) configured for sub-dividing the frequency range into a number of frequency sub-bands (for instance the five bands F1, F2, F3, F4 and F5 described in FIG. 1A, 1B above) and a corresponding synthesis filter bank (FBS) configured to recombine the frequency sub-bands into one single frequency band. An embodiment of a hearing aid as described in FIG. 5A but comprising separate analysis (AFB) and synthesis (SFB) filter banks in the forward path of the hearing aid between the input (IT) and output (OT) transducers is illustrated in FIG. SB. Additionally, the frequency sub-band signals that are input and output signals of the signal processing unit (SPU) are denoted Y(k,m) and Z(k, m), respectively, k being the frequency index (k=1, N) and m being the time frame index.

FIG. 6 shows a simplified block diagram of a signal processing unit according to an embodiment of the present disclosure. The input unit (IU) shown in FIG. 5B provides a time-domain electric input signal y(n) as digital samples representing a composite input sound signal (e.g. comprising a number of speech signal components) in a frequency range of operation of the hearing device, t being time, and n being a time-sample index. The analysis filter bank (FBA) shown in FIG. 5B subdivides the frequency range of operation of the hearing aid, or a part thereof, into a plurality of frequency sub-bands Y(k,m) of the composite sound signal, k being a frequency sub-band index (k=1, N, N being the number of sub-bands), and m being a time-frame index. Each frame comprises a number of samples, e.g. 64 or 128. The frames are non-overlapping or overlapping, typically overlapping. The signal processing unit (SPU), which is connected to the analysis filter bank FBA and receives frequency sub-band signals Y(k,m), comprises a frequency sub-band grouping unit (BGU) for arranging frequency sub-bands (k) in sub-band-groups $SBG_j$, j=1, . . . , $N_{SBG}$, based on comparable characteristics among the plurality of frequency sub-bands Y(k,m), and provides grouped sub-band signals $Y_{SBGj}(k,m)$. $N_{SBG}$ is the number of sub-band groups. $N_{BSG}$ depends e.g. on the type of target signal. $N_{BSG}$ may e.g. depend on the type and number of the currently present noise sources. $N_{BSG}$ is at least one, such as larger than or equal to two. In the exemplary embodiment of FIG. 6, $N_{SBG}$=3. The three sub-band groups SBG1, SBG2, and SBG3 are represented by sub-band signals $Y_{SBG1}(k,m)$, $Y_{SBG2}(k,m)$, $Y_{SBG3}(k,m)$. In an embodiment, the three groups of frequency sub-band signals together constitute the N sub-band signals Y(k,m) of the composite sound signal (e.g. in that the respective sub-band groups together (in a mathematical sense that their union) consist of the frequency sub-bands k=1, . . . , N). The comparable characteristics among the plurality of frequency sub-bands Y(k,m) that is used to form the sub-band groups may e.g. relate to similar modulation properties among the frequency sub-bands. In an embodiment, the comparable characteristics comprises the correlations among the signal envelopes in said multiple frequency sub-bands In an embodiment, the frequency sub-band grouping unit (BGU) is configured to assign a given sub-band to a given sub-band group, if it fulfils a given criterion for the comparable characteristics assigned to that sub-band group (e.g. is within a distance measure from a given value (or is larger than or smaller than a given value, etc.) of the characteristics, e.g. a given correlation value). The signal processing unit (SPU) further comprises an envelope extraction unit (EXU) for calculating a group envelope for each of said sub-band groups $SBG_1$, represented by sub-band signals $Y_{SBG1}(k,m)$, $Y_{SBG2}(k,m)$, $Y_{SBG3}(k,m)$, respectively. The envelope extraction unit (EXU) provides as an output respective group envelope signals $E_G(j)$, j=1, . . . , $N_{SBG}$ (here $N_{SBG}$=3). Each group envelope signal $E_G(\mathbf{1})$, $E_G(\mathbf{2})$, $E_G(\mathbf{3})$ comprises peaks and troughs (as schematically indicated above the envelope extraction unit (EXU)). The group envelope may e.g. be determined as an average of each envelope of the sub-band group in question, or using frequency weighted averaging, where bands are weighted, e.g. by their importance for speech comprehension. The signal processing unit (SPU) further comprises an enhancement unit (EHU) for providing respective enhancement functions $f_e(j)$, j=1, $N_{SBG}$ (here $N_{SBG}$=3). Each enhancement function $f_e(\mathbf{1})$, $f_e(\mathbf{2})$, $f_e(\mathbf{3})$ enhances the peaks and/or attenuates the troughs in respective ones of the group envelope signals $E_G(\mathbf{1})$, $E_G(\mathbf{2})$, $E_G(\mathbf{3})$. Thereby enhanced group envelope signals can be determined $EH_G(j)=E_G(j)*f_e(j)$, j=1, . . . , $N_{SBG}$ (here $N_{SBG}$=3) (as schematically indicated above the enhancement unit (EHU)). In an embodiment, the enhancement functions $f_e(\mathbf{1})$, $f_e(\mathbf{2})$, $f_e(\mathbf{3})$, which are (or may be) different from sub-band group to sub-band group, may also be different from frequency sub-band to frequency sub-band within a sub-band group, e.g. in dependence of a parameter defining a difference between the group envelope of the sub-band group in question and the envelope of the frequency sub-band in question. In other words, $f_e(j)=f_e(j,p)$, where p is a parameter, e.g. related to correlation between group and band envelopes. The frequency sub-band parameter p may thus depend on frequency sub-band index k (and may be time dependent as well, p=p(k,n)). In an embodiment, the enhancement functions $f_e(j)$ for different frequency sub-bands ($k_j$) of a given sub-band group j are scaled versions of $f_e(j)$ (e.g. dependent on a parameter of the individual sub-bands $k_j$). Respective multiplication units 'X' are configured to multiply the frequency sub-band signals ($Y_{SBG1}(k,m)$, $Y_{SBG2}(k,m)$ $Y_{SBG3}(k,m)$ in FIG. 6) in each individual sub-band-group (SBG1, SBG2, SBG3 in FIG. 6) by a respective one of the enhancement functions $f_e(\mathbf{1})$, $f_e(\mathbf{2})$, $f_e(\mathbf{3})$ (or individualized versions thereof $f_e(j,p(k,n))$) to provide enhanced frequency sub-band signals ($ES_{SBG1}(k,m)$, $ES_{SBG2}(k,m)$, $ES_{SBG3}(k,m)$ in FIG. 6). The individual enhanced frequency sub-band signals ES(k,m), k=1, N (constituted by the enhanced sub-band signals $ES_{SBG1}(k,m)$, $ES_{SBG2}(k,m)$, $ES_{SBG3}(k,m)$ in FIG. 6), have been modified by the enhancement of comodulation between frequency sub-bands to thereby improve a user's ability to separate a target signal from noise. In the embodiment of a signal processing unit (SPU) of FIG. 6, the enhanced frequency sub-band signals are processed by (further) processing unit (FPU), e.g. for applying a frequency and/or level dependent gain to the enhanced frequency sub-band signals to provided (further) processed signals Z(k,m), k=1, . . . , N. Other processing algorithms may additionally (or alternatively) be applied in the processing unit (FPU), such as feedback cancellation, noise reduction, etc. In an embodiment, the input unit may comprise more than one microphone, e.g. 2 or more. In an embodiment, the hearing device comprises a multi input beamformer filtering unit for providing a spatially filtered signal. The scheme of providing comodulation in frequency sub-bands of a number of sub-band groups may be applied to each microphone input signal separately and/or to a spatially filtered (beamformed) signal.

Figure 7A:
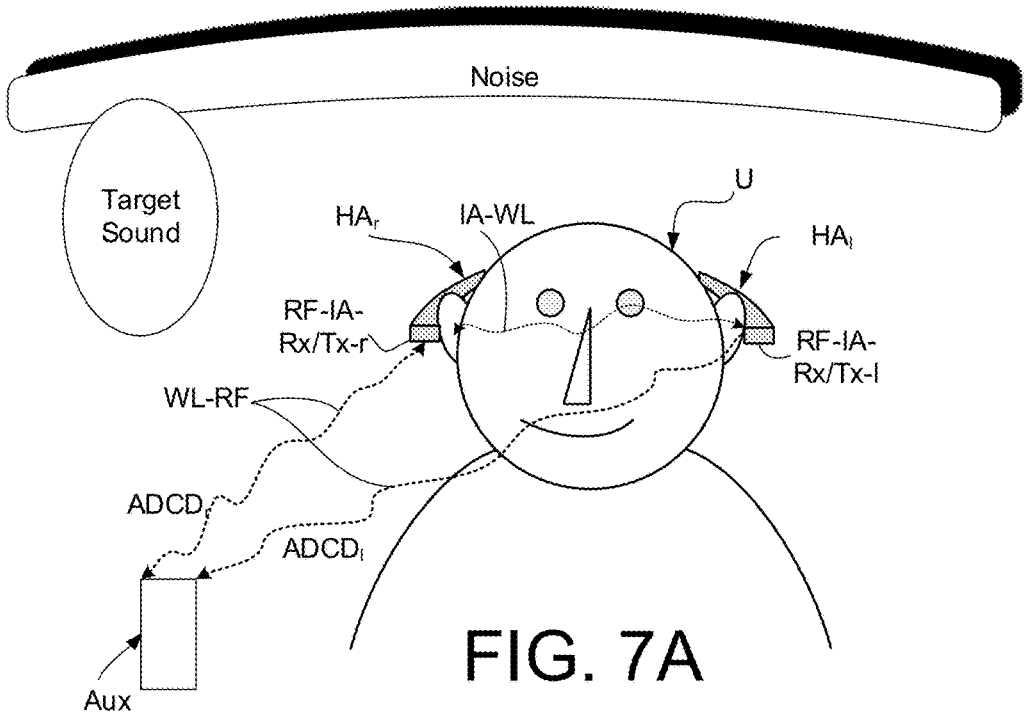
FIG. 7A shows an embodiment of a binaural hearing aid system comprising left and right hearing devices in communication with an auxiliary device.
Figure 7B:
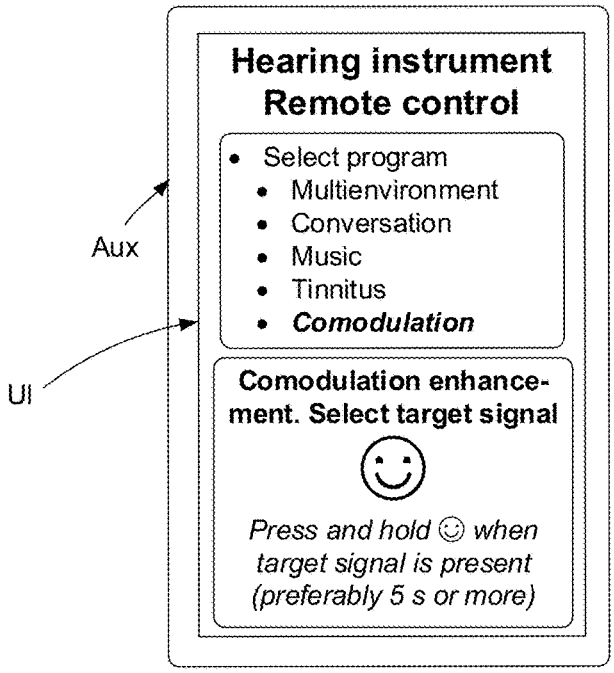
FIG. 7B shows the auxiliary device functioning as a user interface for the binaural hearing aid system according to the present disclosure.

FIG. 7A shows an embodiment of a binaural hearing aid system comprising left and right hearing devices in communication with an auxiliary device, and FIG. 7B shows the auxiliary device functioning as a user interface for the binaural hearing aid system.

FIG. 7A shows an embodiment of a binaural hearing system comprising left (second) and right (first) hearing devices ($HA_l$, $HA_r$) in communication with a portable (handheld) auxiliary device (AD) functioning as a user interface (UI) for the binaural hearing aid system. In an embodiment, the binaural hearing system comprises the auxiliary device (Aux, and the user interface UI). In the embodiment of FIG. 7A, wireless links denoted IA-WL (e.g. an inductive link between the left and right hearing devices) and WL-RF (e.g. RF-links (e.g. Bluetooth) between the auxiliary device Aux and the left $HA_l$, and between the auxiliary device Aux and the right $HA_r$, hearing device, respectively) are indicated (implemented in the devices by corresponding antenna and transceiver circuitry, indicated in FIG. 7A in the left and right hearing devices as RF-IA-Rx/Tx-l and RE-IA-Rx/Tx-r, respectively). In the acoustic situation illustrated by FIG. 7A, a dominant sound source, e.g. a voice of a person, denoted Target Sound, is located to the right of the user (U) and a noise sound field, possibly comprising competing voice/speech signals and/or natural or artificial noise, denoted Noise, is indicated around the user.

The user interface (UI) of the auxiliary device (Aux) is shown in FIG. 7B. The user interface comprises a display (e.g. a touch sensitive display) displaying a screen of a Hearing instrument Remote control APP for controlling the hearing system and a number of predefined actions regarding functionality of the binaural hearing system (or of a bilateral hearing aid system or of single hearing aid). In the exemplified (part of the) APP, a user (U) has the option of influencing a mode of operation via the selection of one of a number of predefined (or configurable) programs, each optimized for specific acoustic situations (in box Select program). The exemplary acoustic situations are: Multienvironment, Conversation, Music, Tinnitus, and Comodulation, each illustrated as an activation element, which is selected one at a time by clicking on the element. Each exemplary acoustic situation is associated with the activation of specific algorithms and specific processing parameters (programs) of the left and right hearing devices. In the example of FIG. 7B, the acoustic situation Comodulation has been chosen, (as indicated by bold italic highlight of the corresponding activation element on the screen). The acoustic situation Comodulation refers to a specific mode of operation of the hearing system, where a target (speech) sound source present in the acoustic environment of the user (as indicated in FIG. 7A by the element Target Sound) together with one or more noise sources (or competing voice sources). In the exemplified remote control APP-screen of FIG. 7B, the user has the option of helping identifying the target sound source (cf. box Comodulation enhancement. Select target signal). The user has the option of clicking on the smiley icon ☺ representing a target source and is encouraged to press (hold down) the icon for a period of time, where the target sound is present in the environment of the user. Thereby, the hearing aid(s) are guided in the task of identifying spectral characteristics of the target signal (cf. (1) in FIG. 1A, 1B, including the frequency sub-bands where the target signal is present) and to apply the appropriate comodulation (characteristic of the 'noise', cf. (2) in FIG. 1A, 1B) in neighbouring frequency sub-bands. Alternatively, this task may be executed automatically, e.g. by the left and right hearing devices individually, or in common, and/or in collaboration with the auxiliary device (e.g. using one or more microphone signals of an auxiliary device). The noise components (denoted 'Noise' in FIG. 7A) can be 'artificial' noise from traffic, car noise, mechanical devices (fans, air condition, etc.), but may also include (competing) voices from other persons than the target source.

The auxiliary device Aux comprising the user interface UI is adapted for being held in a hand of a user (U), and hence convenient for displaying information about the hearing aid system and/or for the user to influence its function. In an audio streaming mode of operation of the hearing system, audio signals (e.g. from a telephone conversation or a music or other sounds) may be transferred from the auxiliary device to the left and right hearing aids (using wireless links WL-RF, and optionally IA-WL), cf. signals $ADCD_l$ and $ADCD_r$ in FIG. 7A). In a remote control mode of operation (as illustrated in FIG. 7B), control data and/or information data (and/or audio data) may be exchanged between the auxiliary device and the left and right hearing devices (using wireless links WL-RF, and optionally IA-WL), cf. signals $ADCD_l$ and $ADCD_r$ in FIG. 7A.

The wireless communication link(s) (WL-RF, IA-WL in FIG. 7A) between the hearing devices and the auxiliary device and between the left and right hearing devices may be based on any appropriate technology with a view to the necessary bandwidth and available part of the frequency spectrum. In an embodiment, the wireless communication link (WL-RF) between the hearing devices and the auxiliary device is based on far-field (e.g. radiated fields) communication e.g. according to Bluetooth or Bluetooth Low Energy or similar standard or proprietary scheme. In an embodiment, the wireless communication link (IA-WL) between the left and right hearing devices is based on near-field (e.g. inductive) communication.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore. "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Hall et al., 1984] Hall, J. W., Haggard, M. P., Fernandes, M. A. (1984). "Detection in noise by spectro-temporal pattern analysis", J. Acoust. Soc. Am. 76, 50-56.

[Nelken et al., 1999] Nelken I., Rotman Y., and Yosef O. B. (1999). "Responses of auditory cortex neurons to structural features of natural sounds," Nature 397, 154-157.

The invention claimed is:

1. A hearing device for improving a hearing impaired user's ability to perceptually separate a target sound from competing sounds, the target sound and the competing sounds forming a composite sound signal having a given frequency range, the hearing device comprising an input unit for providing a time-domain electric input signal y(n) as digital samples representing said composite sound signal in a frequency range of operation forming part of said given frequency range, n being a time-sample index, an analysis filter bank subdividing said frequency range of operation, or a part thereof, of said composite sound signal into a plurality of frequency sub-bands and providing corresponding frequency sub-band signals;

a signal processor connected to said analysis filter bank and configured to arrange frequency sub-bands in sub-band-groups based on comparable characteristics among the plurality of frequency sub-band signals;

calculate a group envelope for each of said sub-band groups, said group envelope comprising peaks and troughs;

provide an enhancement function for each sub-band group configured to enhances said peaks in the group envelope and/or attenuate said troughs in the group envelope; and multiply a signal in the frequency sub-bands of each individual sub-band-group by a respective enhancement function for the sub-band group in question, or a scaled version thereof, to provide enhanced frequency sub-band signals.

2. A hearing device according to claim 1 wherein the signal processor is further configured to apply a frequency and/or level dependent gain or attenuation and/or other signal processing algorithms to said frequency sub-band signals or to said enhanced frequency sub-band signals to provide processed frequency sub-band signals.

3. A hearing device according to claim 1 comprising a synthesis filter bank for converting said processed frequency sub-band signals to a time-domain electric output signal.

4. A hearing device according to claim 3 comprising an output unit for converting said time-domain electric output signal to stimuli perceivable by the user as sound.

5. A hearing device according to claim 1 comprising a hearing aid, a headset, an earphone, an ear protection device or a combination thereof.

6. A hearing system comprising a hearing device according to claim 1; and an auxiliary device, wherein the hearing system is adapted to establish a communication link between the hearing device and the auxiliary device to provide that information can be exchanged or forwarded from one to the other.

7. A hearing system according to claim 6 wherein the auxiliary device is or comprises an audio gateway device, a remote control for controlling functionality and operation of the hearing device(s), a smartphone or a combination thereof.

8. A hearing system according to claim 6 configured to run an APP allowing to control functionality of the hearing system via the auxiliary device.

9. A method for improving a hearing impaired person's ability to perceptually separate a target sound from competing sounds, the target sound and the competing sounds forming a composite sound signal having a given frequency range, the method comprising providing a time-domain electric input signal y(n) as digital samples representing said composite sound signal in a frequency range of operation forming part of said given frequency range, n being a time-sample index, subdividing said frequency range of operation, or a part thereof, of said composite sound signal into a plurality of frequency sub-band;

arranging frequency sub-bands in sub-band-groups based on comparable characteristics among the plurality of frequency sub-bands;

calculating a group envelope for each of said sub-band groups, said group envelope comprising peaks and troughs; and multiplying a signal in the frequency sub-bands of each individual sub-band-group by a function that enhances said peaks of the group envelope and/or attenuates said troughs in the group envelope, thereby providing an enhancement envelope for each of said sub-band-groups.

10. Method according to claim 9, wherein said comparable characteristic comprises the correlations among the signal envelopes in said multiple frequency sub-bands.

11. A method according to claim 9, comprising the steps of:

for each of said frequency sub-bands calculate the envelope of the band;

for each of the sub-band-groups calculate the correlation between the envelope of each of the frequency sub-bands in the specific sub-band-group and the corresponding group envelope;

for each of the sub-band groups calculate the enhancement envelope for each frequency sub-band in the sub-band-group in question; and for each frequency sub-band multiply the signal in the band with the enhancement envelope of the band.

12. A method according to claim 9 comprising the steps of:

calculate the correlation between the envelopes of each of said frequency sub-bands, thereby providing a correlation matrix C;

based on said correlation matrix C group the frequency sub-bands into said sub-band-groups; and calculate a group envelope for each of the sub-band-groups.

13. A method according to claim 9, wherein said grouping comprises the following steps:

defining a threshold for correlation C_thr;

selecting the row of the correlation matrix C that has the highest sum of supra-threshold values; and designating the frequency sub-bands for which correlations in the selected row are greater than C_thr as the members of a first sub-band-group.

14. A method according to claim 13, wherein said grouping further comprises setting the elements in the rows and columns of the correlation matrix C corresponding to the frequency sub-bands of said first sub-band-group equal to zero, thereby providing a modified correlation matrix $C_M$;

selecting the row of the modified correlation matrix $C_M$ that has the highest sum of suprathreshold correlations; and designating the frequency sub-bands for which correlations in the selected row are greater than C_thr as members of a second sub-band-group.

15. A method according to claim 9 wherein said enhancement of peaks of the group envelope and attenuation of troughs in the group envelope comprises the following steps:

defining a modulation enhancement m_enh;

for the defined modulation enhancement (m_enh) keeping a running tally of the group envelope's mean value, modulation depth m_group and the current amplitude offset at time n relative to said mean value, where the modulation depth is given by m_group;

for each frequency sub-band in each respective sub-band-group:

multiplying the signal in a current time window by (1+p(n)*c(n)*m_enh), where $0 \leq p(n) \leq 1$, and where p(n) is a function of the band envelope's correlation with the group envelope.

16. A method according to claim 9 wherein said modulation enhancement m_enh is divided in two enhancement parts, one that controls the extent of peak enhancement and one that controls the extent of deepening of troughs.

17. A method according to claim 9, wherein said comparable characteristics are fundamental frequencies $F_{0k}$ in the amplitude variation of each separate frequency sub-band, where k is a frequency sub-band index.

18. A data processing system comprising a processor and program code means for causing the processor to perform the method of claim 9.

19. A hearing device for improving a hearing impaired user's ability to perceptually separate a target sound from competing sounds, where the hearing device comprises a data processing system according to claim 18.

20. A hearing device configured to operate at least partially on a frequency sub-band level, and configured to improve perception of a target speech signal received by the hearing device as a composite signal comprising said target speech signal and competing sound components, the hearing device comprising a signal processor providing perception enhancement based on comodulation, where comodulation refers to amplitude modulations that are shared across multiple frequency sub-bands, and wherein the signal processor is configured to enhance comodulation cues of said competing sound.

21. A hearing device, according to claim 20 wherein the signal processor is configured to monitor modulation of competing sound components in at least some selected frequency sub-bands.

22. A hearing device, according to claim 21 wherein the signal processor is configured to apply comodulation reflecting said modulation of the competing sound components to at least some of the frequency sub-bands.

23. A hearing device, according to claim 20 wherein the signal processor is configured to monitor amplitude modulation of competing sound components in at least some selected frequency sub-bands.

* * * * *